US008297292B2

(12) United States Patent
Kokubo et al.

(10) Patent No.: US 8,297,292 B2
(45) Date of Patent: Oct. 30, 2012

(54) CLEANING DEVICE AND CLEANING METHOD OF SEMICONDUCTOR MANUFACTURING APPARATUS

(75) Inventors: Takayuki Kokubo, Kanagawa (JP); Jun Yamawaku, Yamanashi (JP); Tsuyoshi Moriya, Tokyo (JP)

(73) Assignee: Tokyo Electron Limited, Tokyo (JP)

( * ) Notice: Subject to any disclaimer, the term of this patent is extended or adjusted under 35 U.S.C. 154(b) by 227 days.

(21) Appl. No.: 12/510,314

(22) Filed: Jul. 28, 2009

(65) Prior Publication Data

US 2010/0018552 A1 Jan. 28, 2010

(30) Foreign Application Priority Data

Jul. 28, 2008 (JP) ..... 2008-193425

(51) Int. Cl.
*B08B 3/04* (2006.01)

(52) U.S. Cl. ..... 134/104.2; 134/902

(58) Field of Classification Search ..... 134/104.2, 134/902

See application file for complete search history.

(56) References Cited

U.S. PATENT DOCUMENTS

| | | | | |
|---|---|---|---|---|
| 6,311,365 | B1 * | 11/2001 | Dornier | 15/302 |
| 2003/0051742 | A1 * | 3/2003 | Boyers | 134/30 |

FOREIGN PATENT DOCUMENTS

| | | | | |
|---|---|---|---|---|
| JP | 59193291 | A | * | 11/1984 |
| JP | 59-193291 | A | | 12/1984 |
| JP | 63-151347 | A | | 6/1988 |
| JP | 64-014599 | A | | 1/1989 |
| JP | 64014599 | | * | 1/1989 |
| JP | 64-043384 | A | | 2/1989 |
| JP | 06-262599 | B2 | | 9/1994 |
| JP | 2554588 | B2 | | 8/1996 |
| JP | 3089151 | U | | 7/2002 |
| JP | 2003-273078 | A | | 9/2003 |
| JP | 2004-088065 | A | | 3/2004 |
| JP | 2005-046777 | A | | 2/2005 |
| JP | 2005286221 | A | * | 10/2005 |
| WO | WO03092463 | A1 | * | 11/2003 |
| WO | 2004-001830 | A1 | | 12/2003 |
| WO | WO 2004001830 | A1 | * | 12/2003 |

OTHER PUBLICATIONS

Japanese Office action for 2008-193425 dated May 25, 2010.
Japanese Office action for 2008-193425 dated Jan. 25, 2011.
Korean Office action for 10-2009-0068521 dated Mar. 11, 2011.

* cited by examiner

*Primary Examiner* — Michael Barr
*Assistant Examiner* — Charles W Kling
(74) *Attorney, Agent, or Firm* — Pearne & Gordon LLP

(57) ABSTRACT

Provided are a cleaning device and a cleaning method of a semiconductor manufacturing apparatus, capable of performing a cleaning process more effectively as compared to conventional cases and obtaining a high cleaning effect. A semiconductor manufacturing apparatus cleaning device 100 includes a pure water steam generating vessel 2 for generating pure water steam from pure water; a supply port 5 for supplying the pure water steam to a cleaning target portion; a supply line 4 for connecting the pure water steam generating vessel with the supply port; a collection port 6 for collecting steam used in cleaning from the cleaning target portion; a collection vessel 8 for condensing and collecting the used steam; and a collection line 7 for connecting the collection port 6 with the collection vessel 8.

16 Claims, 7 Drawing Sheets

CLEANING DEVICE AND CLEANING METHOD OF SEMICONDUCTOR MANUFACTURING APPARATUS

FIELD OF THE INVENTION

The present disclosure relates to a cleaning device and a cleaning method of a semiconductor manufacturing apparatus which manufactures a semiconductor device by processing a semiconductor wafer or the like.

BACKGROUND OF THE INVENTION

Conventionally employed in a manufacturing process of a semiconductor device is a semiconductor manufacturing apparatus which manufactures a semiconductor device by processing a substrate such as a semiconductor wafer. In such a semiconductor manufacturing apparatus, for example, a film forming apparatus or an etching apparatus, the inside of a processing chamber for processing a semiconductor wafer therein may be contaminated with deposits or particles when the process is performed. For this reason, the semiconductor manufacturing apparatus is cleaned for maintenance thereof.

In most cases, the cleaning of the semiconductor manufacturing apparatus is carried out manually by wiping it with a dry cloth or with a cloth using ethanol or the like by an operator. Further, when the cleaning is performed after parts of the semiconductor manufacturing apparatus are separated, there is also known a method for cleaning them by air jet cleaning or ultrasonic cleaning (see, for example, Patent Document 1).

Patent Document 1: Japanese Patent Laid-open Publication No. 2003-273078

BRIEF SUMMARY OF THE INVENTION

As mentioned above, a semiconductor manufacturing apparatus is conventionally cleaned by wiping it with a non-woven fabric or the like. In such a cleaning method, however, since the wiping is performed manually, a cleaning effect may not be regular depending on operators, and a quantitative cleaning effect is hard to obtain. Further, a place beyond the reach of an operator's hand, a very narrow place or a place having a protrusion or a recess inside the apparatus may not be cleaned sufficiently, so that particles could exist even after the cleaning. Moreover, a secondary contamination could be caused depending on the cleaning process, and a safety issue may also occur because an operator directly makes contact with deposits or the like.

Furthermore, when the cleaning is carried out by ultrasonic cleaning or air jet cleaning, parts need to be cleaned after they are separated. Thus, it takes time and effort to carry out the cleaning operation.

In view of the foregoing, the present disclosure provides a cleaning device and a cleaning method of a semiconductor manufacturing apparatus, capable of carrying out a cleaning process more effectively as compared to conventional cases and obtaining a high cleaning effect.

In accordance with one aspect of the present disclosure, there is provided a cleaning device of a semiconductor manufacturing apparatus, the device including: a pure water steam generating vessel for generating pure water steam from pure water; a supply port for supplying the pure water steam to a cleaning target portion; a supply line for connecting the pure water steam generating vessel with the supply port; a collection port installed around the supply port, for collecting steam used in cleaning from the cleaning target portion; a collection vessel for condensing and collecting the used steam; and a collection line for connecting the collection port with the collection vessel.

In the above-described cleaning device, the collection port may have a protruded shape such that a part of a sidewall portion of an opening end of a cylindrical member is protruded in an inverse-V shape.

In the above-described cleaning device, the collection port may have a recessed shape such that a part of facing sidewall portions of an opening end of a cylindrical member is recessed in a V shape.

In the above-described cleaning device, at least a circumference of an opening portion of the collection port may be formed of an elastic member.

In the above-described cleaning device, the supply line and the collection line may be configured to have a double tube structure at a part of the supply port and the collection port.

In the above-described cleaning device, a contact surface of the supply line with the pure water steam may be made of resin.

In the above-described cleaning device, a contact portion of the supply line with the pure water steam or a non-contact surface of the supply line with the pure water steam may be made of a conductive material.

In the above-described cleaning device, a heater for generating the pure water steam may be installed at a lower half part of the pure water steam generating vessel.

In the above-described cleaning device, the pure water steam generating vessel may be configured to store the pure water in the lower half part thereof.

In the above-described cleaning device, a contact surface of the pure water steam generating vessel with the pure water may be made of resin.

In accordance with another aspect of the present disclosure, there is provided a cleaning method of a semiconductor manufacturing apparatus, the method including: generating pure water steam from pure water in a pure water steam generating vessel; supplying the pure water steam from the pure water steam generating vessel to a supply port through a supply line; supplying the pure water steam to a cleaning target portion from the supply port; collecting steam used in cleaning from the cleaning target portion by a collection port installed around the supply port; collecting the used steam from the collection port into a collection vessel through a collection line; and condensing the used steam in the collection vessel.

In accordance with the present disclosure, there can be provided a cleaning device and a cleaning method of a semiconductor manufacturing apparatus, capable of performing a cleaning process more effectively as compared to conventional cases and obtaining a high cleaning effect.

BRIEF DESCRIPTION OF THE DRAWINGS

The disclosure may best be understood by reference to the following description taken in conjunction with the following figures.

DETAILED DESCRIPTION OF THE INVENTION

Hereinafter, a cleaning device and a cleaning method of a semiconductor manufacturing apparatus in accordance with an embodiment of the present disclosure will be described in detail with reference to the accompanying drawings.

Figure 1:
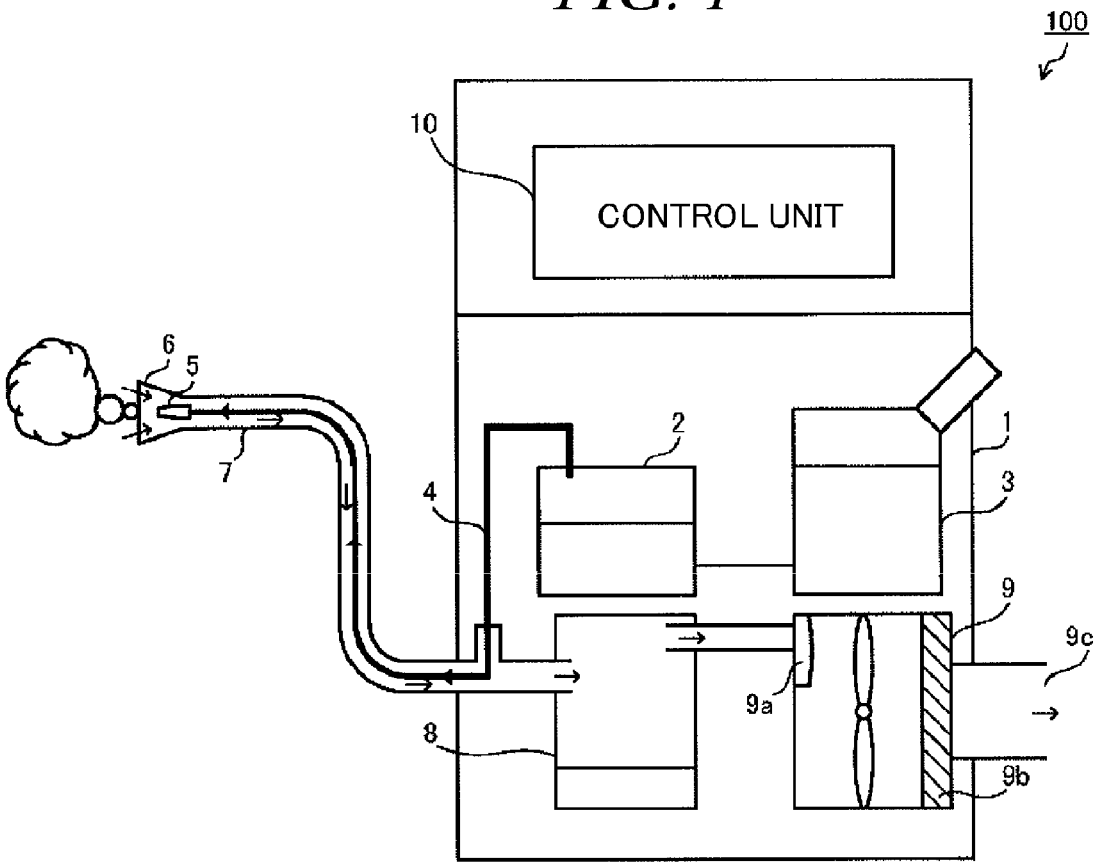
FIG. 1 is a view of a schematic configuration of a semiconductor manufacturing apparatus cleaning device in accordance with an embodiment of the present disclosure.

FIG. 1 illustrates a configuration view of a semiconductor manufacturing apparatus cleaning device in accordance with an embodiment of the present disclosure. As shown in FIG. 1, a semiconductor manufacturing apparatus cleaning device 100 includes a case 1 for accommodating components therein. Installed in the case 1 is a pure water steam generating vessel 2 for generating pure water steam from pure water (including ultrapure water).

The pure water steam generating vessel 2 is made of a metal such as stainless steel to accommodate therein pure water steam at high temperature and high pressure. Further, in order to prevent impurities such as metal ions from being introduced into the pure water or the pure water steam, the pure water steam generating vessel 2's inner surface making contact with the pure water and the pure water steam is made of resin. As a method for forming the inner surface in contact with the pure water and the pure water steam by using the resin, a method of coating the resin on the inner surface of the pure water steam generating vessel 2 can be employed. For example, PEEK (product name (polyether ether ketone)), PFA (perfluoroalkoxy alkane), or the like may be used as such resin. Alternatively, an electrolytic polishing method or a chemical polishing method can be employed.

Figure 2:
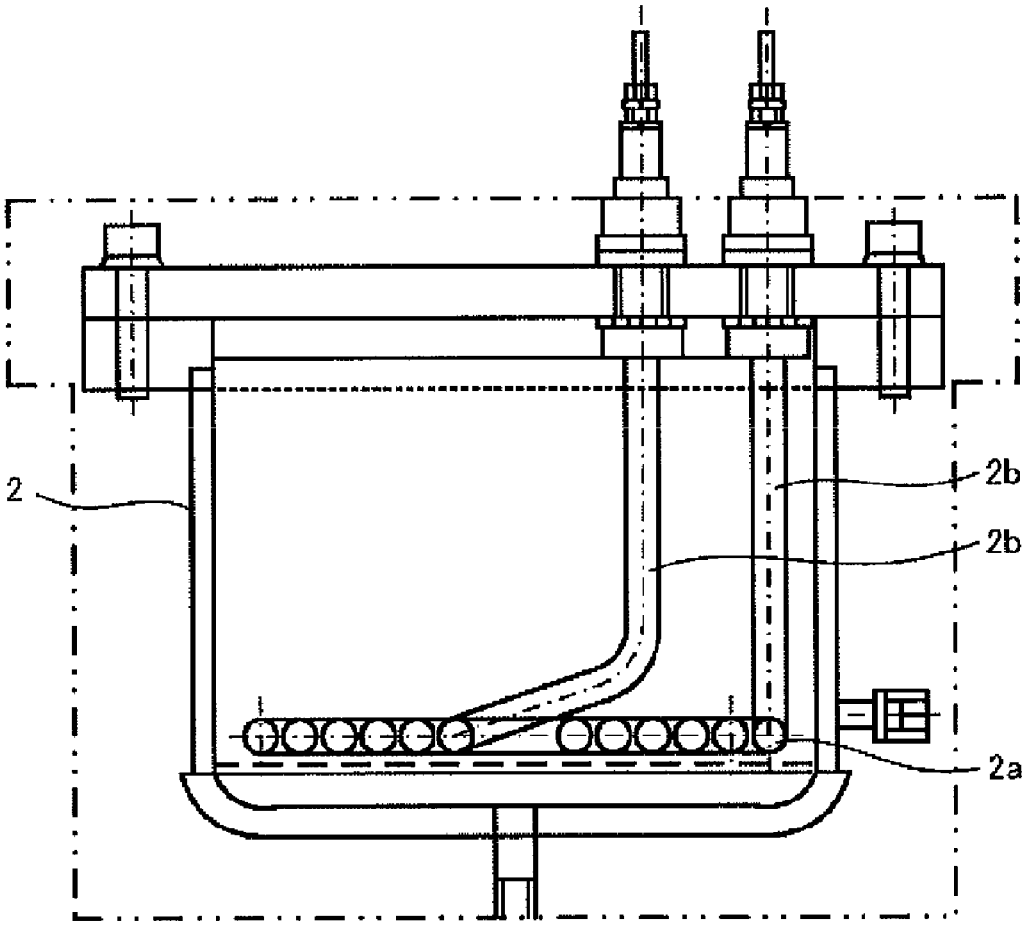
FIG. 2 is a view of a schematic configuration of a major component of the semiconductor manufacturing apparatus cleaning device of FIG. 1.

As depicted in FIG. 2, a heater 2a is installed in the pure water steam generating vessel 2. The heater 2*a* is disposed at the vicinity of a bottom portion of the pure water steam generating vessel 2 to be located at a lower half part of the inside of the pure water steam generating vessel 2. Power supply units 2*b* for supplying power to the heater 2*a* are extended out of the pure water steam generating vessel 2 through an upper portion thereof. By allowing the power supply units 2*b* to be extended out of the pure water steam generating vessel 2 through the upper portion thereof, the heater (heat generation unit) 2*a* can be more easily positioned at the vicinity of the bottom portion of the inside of the pure water steam generating vessel 2. The heater 2*a* generates heat of high temperature, for example, about 150° C., and generates pure water steam from the pure water in the pure water steam generating vessel 2.

As illustrated in FIG. 1, a pure water tank 3 is connected with the pure water steam generating vessel 2, and the pure water is supplied from the pure water tank 3 into the pure water steam generating vessel 2. Further, the upper portion of the pure water steam generating vessel 2 is connected with one end of a supply line 4, and a supply port 5 for supplying the pure water steam to a cleaning target portion is installed at the other end of the supply line 4.

Figure 3:
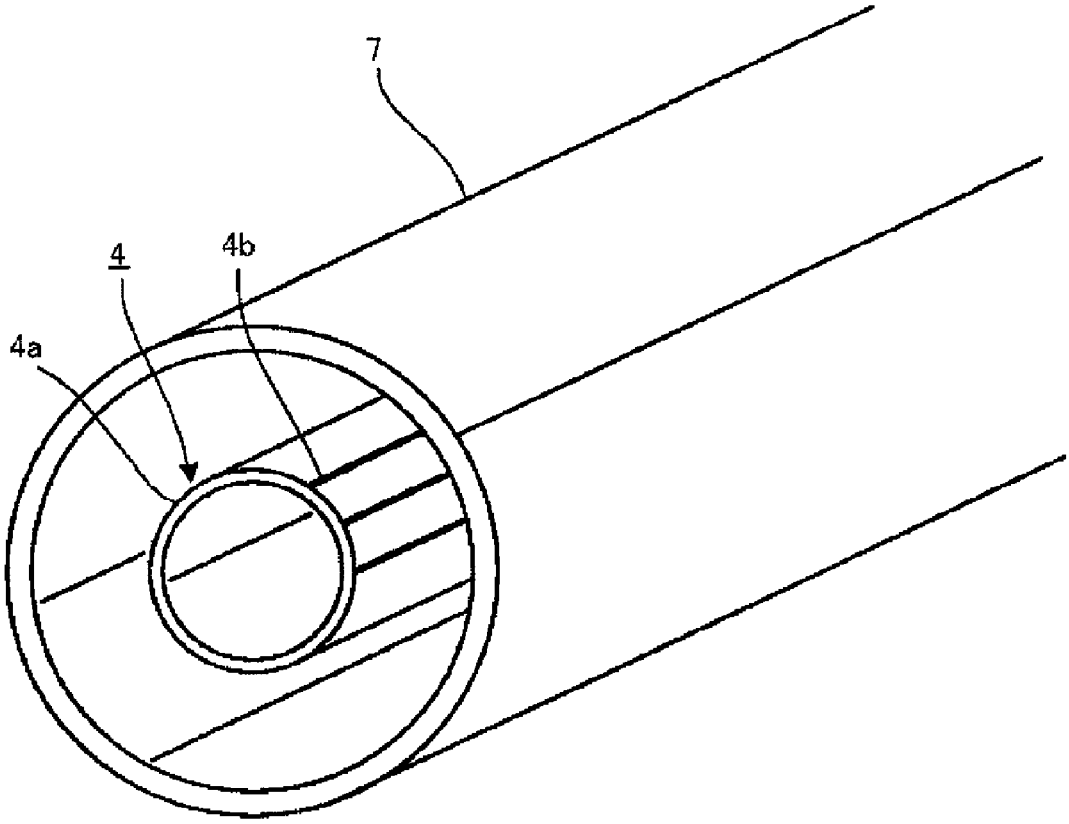
FIG. 3 is a view of a schematic configuration of a major component of the semiconductor manufacturing apparatus cleaning device of FIG. 1.

The supply line 4 is made of a pliable member of annular shape, and the pure water steam flows through the inside of the supply line 4. Further, in order to prevent impurities such as metal ions from being introduced to the pure water steam, the supply line 4's inner surface in contact with the pure water steam is made of resin (PFA in the present embodiment). In the present embodiment, the supply line 4 has, as depicted in FIG. 3, a structure in which a conductive layer 4*b* made of a conductive member (conductive PFA in the present embodiment) is disposed outside a sidewall portion 4*a* made of resin, and the conductive layer 4*b* is connected with a ground potential. Further, a collection line 7 to be described later is installed outside of the supply line 4 to have a double pipe structure.

The conductive layer 4*b* is provided to prevent the supply line 4 from being charged with static electricity generated by the pure water steam flowing through the inside of the supply line 4. In the present embodiment, Naflon PFA-NE Tube (product name: product of Nichias Corp.) was used as a tube for forming the supply line 4. If such an anti-charging method were not prepared, an error of a control unit 10, which will be described later, would be caused by the charge of the static electricity, or a discharge of the static electricity would occur when an operator touches the supply line 4.

As illustrated in FIG. 1, a collection port 6 is provided around the supply port 5 such that it protrudes further toward a leading end than the supply port 5. The collection port 6 is configured to collect the steam that has been supplied to the cleaning target portion and used to clean it and, also, to collect substances peeled off from the cleaning target portion by the cleaning process. The collection port 6 is configured to have a double tube structure in which the collection line 7 is installed outside the supply line 4. The collection line 7 is made of a pliable material, and it can be flexibly bent even at the double tube structured part. Further, the collection line 7 is also made of a conductive material to prevent accumulation of static electricity in the process of collecting the used steam. In the present embodiment, TAC Duct AS (product name: product of Totaku Industries, Inc.) was used as a tube for forming the collection line 7.

The collection line 7 is made of a pliable resin member having a cylindrical shape such that it may be transformed to some degree according to the shape of the cleaning target portion when the cleaning is performed while supplying the pure water steam to the cleaning target portion. Further, since the collection port 6 is a portion that is brought into direct contact with the inside of a processing chamber or the like of the semiconductor manufacturing apparatus to be cleaned, it needs to be made of a material flexible enough not to cause a scratch on the processing chamber or the like and capable of preventing contamination by impurities or particles.

An end of the collection line 7 is connected to a collection vessel 8 installed inside the case 1. The collection vessel 8 is configured to condense the collected pure water steam after the cleaning process into water and to store the water therein. A vacuum cleaner 9 serving as a suction source for collecting the pure water steam is connected to the collection vessel 8.

An inlet filter 9*a* is installed at an inlet side of the vacuum cleaner 9 to prevent the particles or the like removed by the cleaning process from entering into the vacuum cleaner 9. Further, an outlet filter 9*b* is installed at an outlet side of the vacuum cleaner 9 to prevent the particles or the like from being dispersed into a clean room. Furthermore, an exhaust port 9*c* at the outlet side of the vacuum cleaner 9 is configured to be connectable with an exhaust path of the clean room.

Further, the aforementioned control unit 10 is installed at an upper portion of the case 1 to control the respective components described above.

Figure 4:
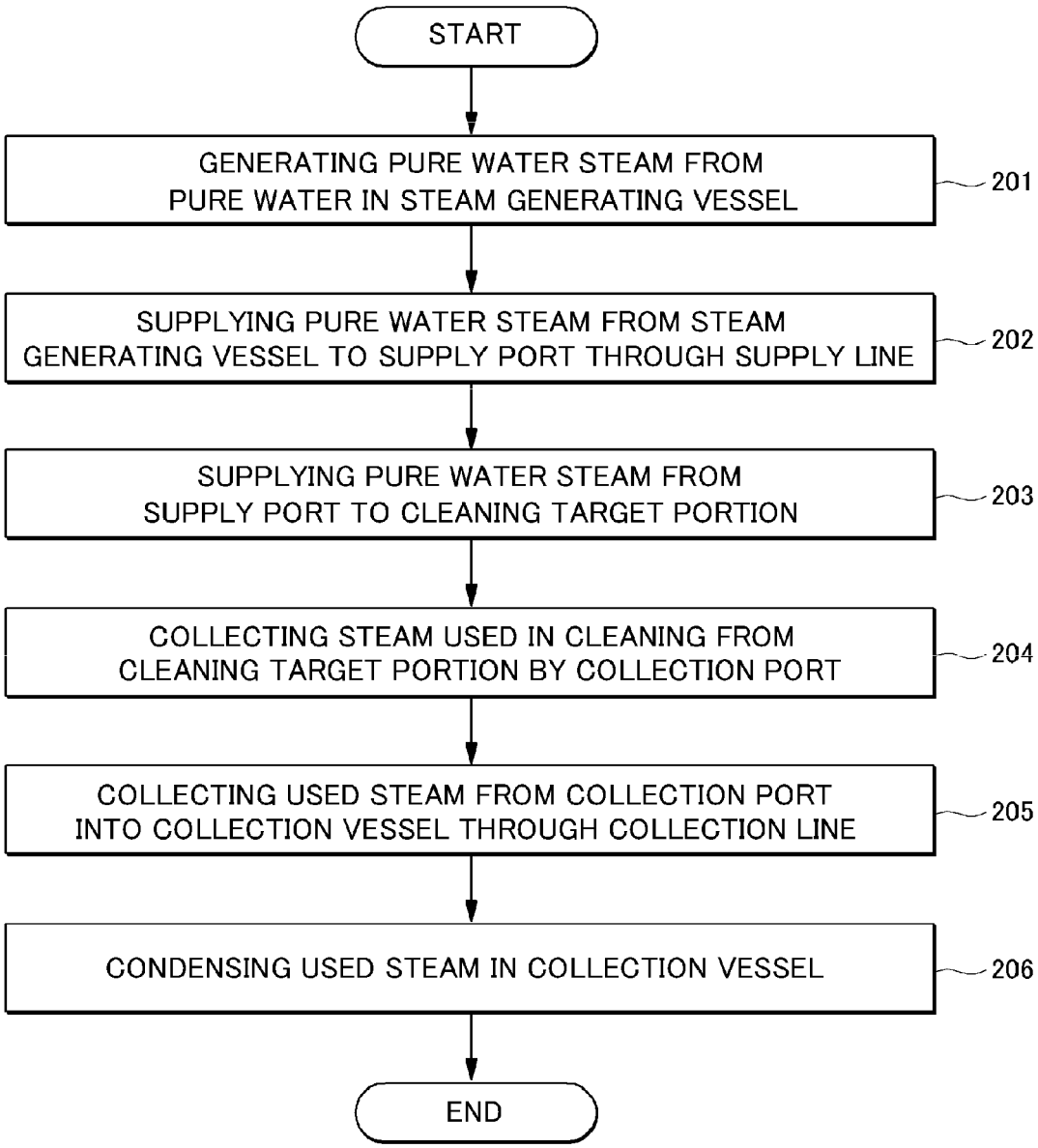
FIG. 4 is a flowchart illustrating a semiconductor manufacturing apparatus cleaning method in accordance with an embodiment of the present disclosure.

When the semiconductor manufacturing apparatus is cleaned by using the semiconductor manufacturing apparatus cleaning device 100 having the above configuration, cleaning is carried out as follows, as depicted in a flowchart of FIG. 4.

After pure water is previously supplied into the pure water steam generating vessel 2 from the pure water tank 3, pure water steam is generated from the pure water by heating the pure water with the heater 2*a*, and the pure water steam is stored in the pure water steam generating vessel 2 (201).

Then, while pressing the collection port 6 against a cleaning target portion of the semiconductor manufacturing apparatus, the pure water steam is supplied from the pure water steam generating vessel 2. At this time, the pure water steam, which is generated and stored in the pure water steam generating vessel 2, is supplied from the pure water steam generating vessel 2 into the supply port 5 through the supply line 4 (202), and then is supplied toward the cleaning target portion from the supply port 5 (203). By the injection of the pure water steam, deposits, particles or the like adhered to the cleaning target portion are removed.

Then, the deposits, particles or the like peeled off from the cleaning target portion are collected from the cleaning target portion through the collection port 6 together with the used steam (204).

Thereafter, the used steam and the deposits, particles or the like peeled off from the cleaning target portion are collected into the collection vessel 8 from the collection port 6 through the collection line 7 (205).

Subsequently, the used steam collected into the collection vessel 8 is cooled and condensed in the collection vessel 8 (206). Then, the condensed water is stored in the collection vessel 8. Further, the deposits, particles or the like peeled off from the cleaning target portion are also stored in the collection vessel 8.

Figure 5:
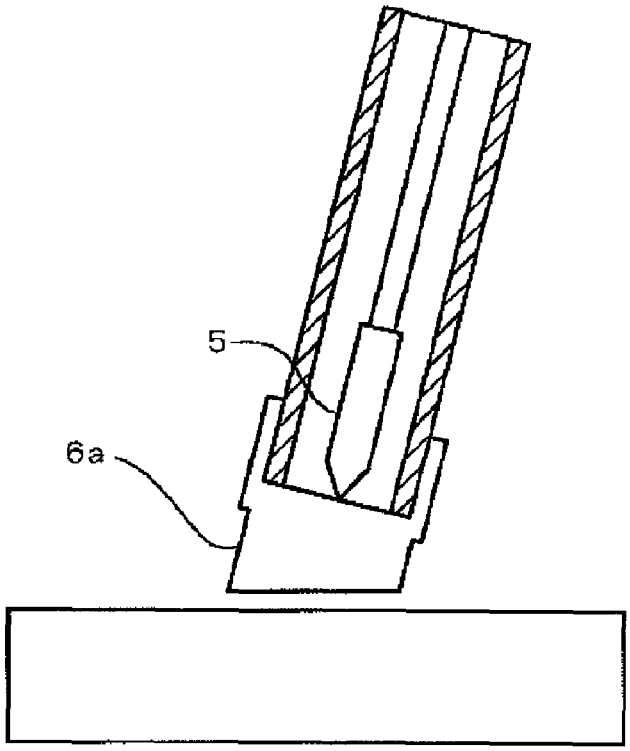
FIG. 5 is a view of a schematic configuration of a major component of the semiconductor manufacturing apparatus cleaning device of FIG. 1.
Figure 6:
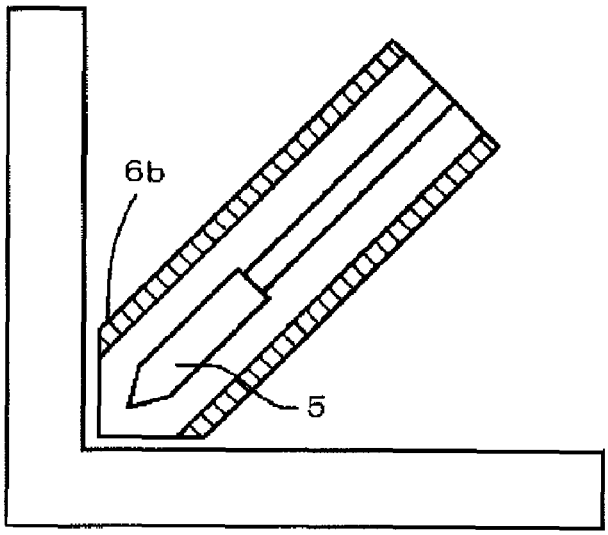
FIG. 6 is a view of a schematic configuration of a major component of the semiconductor manufacturing apparatus cleaning device of FIG. 1.
Figure 7:
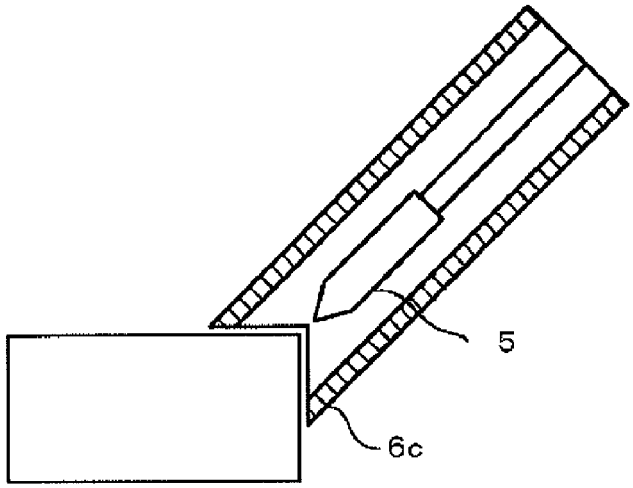
FIG. 7 is a view of a schematic configuration of a major component of the semiconductor manufacturing apparatus cleaning device of FIG. 1.

When the above-stated cleaning operation is performed, if a flat portion is cleaned, there is used a collection port 6*a* whose opening end making contact with the cleaning target portion has a flat shape, as illustrated in FIG. 5. Further, as depicted in FIG. 6, when cleaning a portion where cleaning target surfaces intersect at a substantially right angle such as a corner portion between a sidewall portion and a bottom portion of the inside of a processing chamber or the like, there is utilized a collection port 6*b* whose opening end making contact with the cleaning target portion has a protruded shape such that a part of a sidewall portion of the opening end of a cylindrical member is protruded in an inverse-V shape. Alternatively, as shown in FIG. 7, when cleaning a portion where cleaning target surfaces of an angled portion of a member intersect at an angle of about 270 degrees, there is utilized a collection port 6*c* whose opening end making contact with the cleaning target portion has a recessed shape such that a part of facing sidewall portions of the opening end of a cylindrical member is recessed in a V shape.

Figure 8:
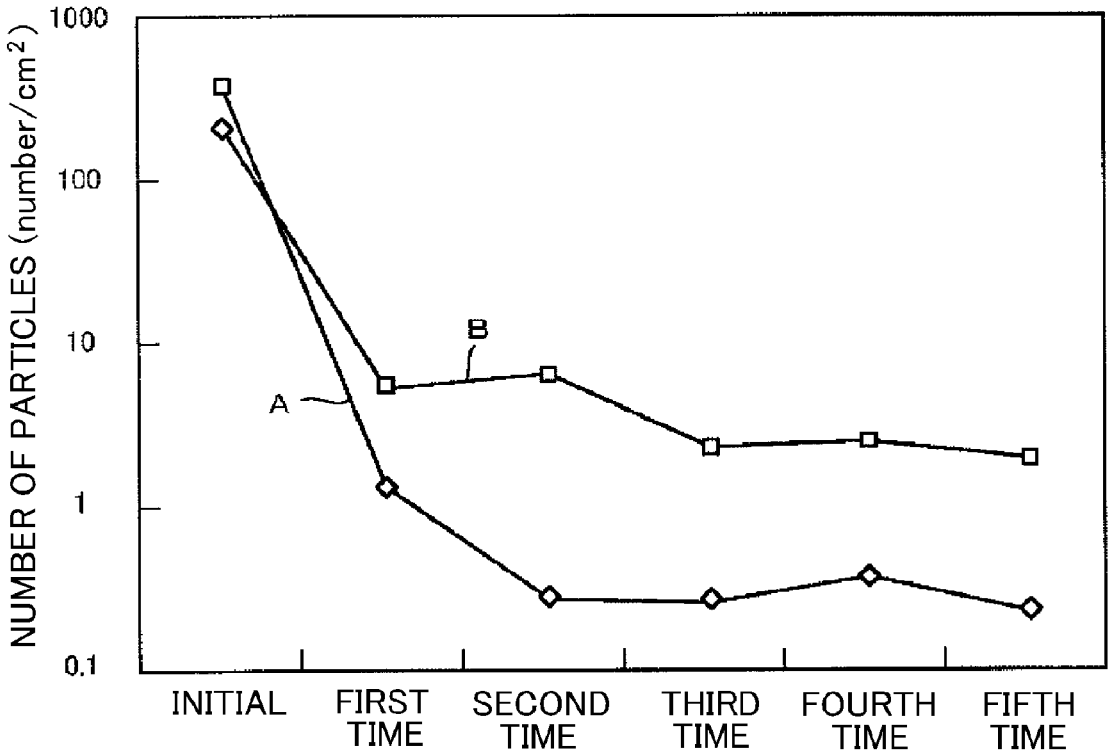
FIG. 8 is a graph showing results of a dust cleaning effect of the semiconductor manufacturing apparatus cleaning device of FIG. 1.

FIG. 8 is a graph showing a comparison result of cleaning effects between a case in which cleaning for removing particles adhered to quartz-made parts of a semiconductor manufacturing apparatus is performed by the semiconductor manufacturing apparatus cleaning device 100 in accordance with the above-described embodiment and a case in which cleaning is performed by wiping the parts with a nonwoven fabric using alcohol. In FIG. 8, a vertical axis indicates the number of particles per unit area adhered to the quartz-made parts of the semiconductor manufacturing apparatus, and a solid line A shows a result of using the semiconductor manufacturing apparatus cleaning device 100 and a solid line B shows a result of wiping the parts with the nonwoven fabric using alcohol. The cleaning was performed 5 times in total, and the number of particles adhered to the parts was counted for each cleaning. As shown in FIG. 8, when using the semiconductor manufacturing apparatus cleaning device 100, the number of particles can be reduced by about one digit place as compared to the case of wiping.

Figure 9:
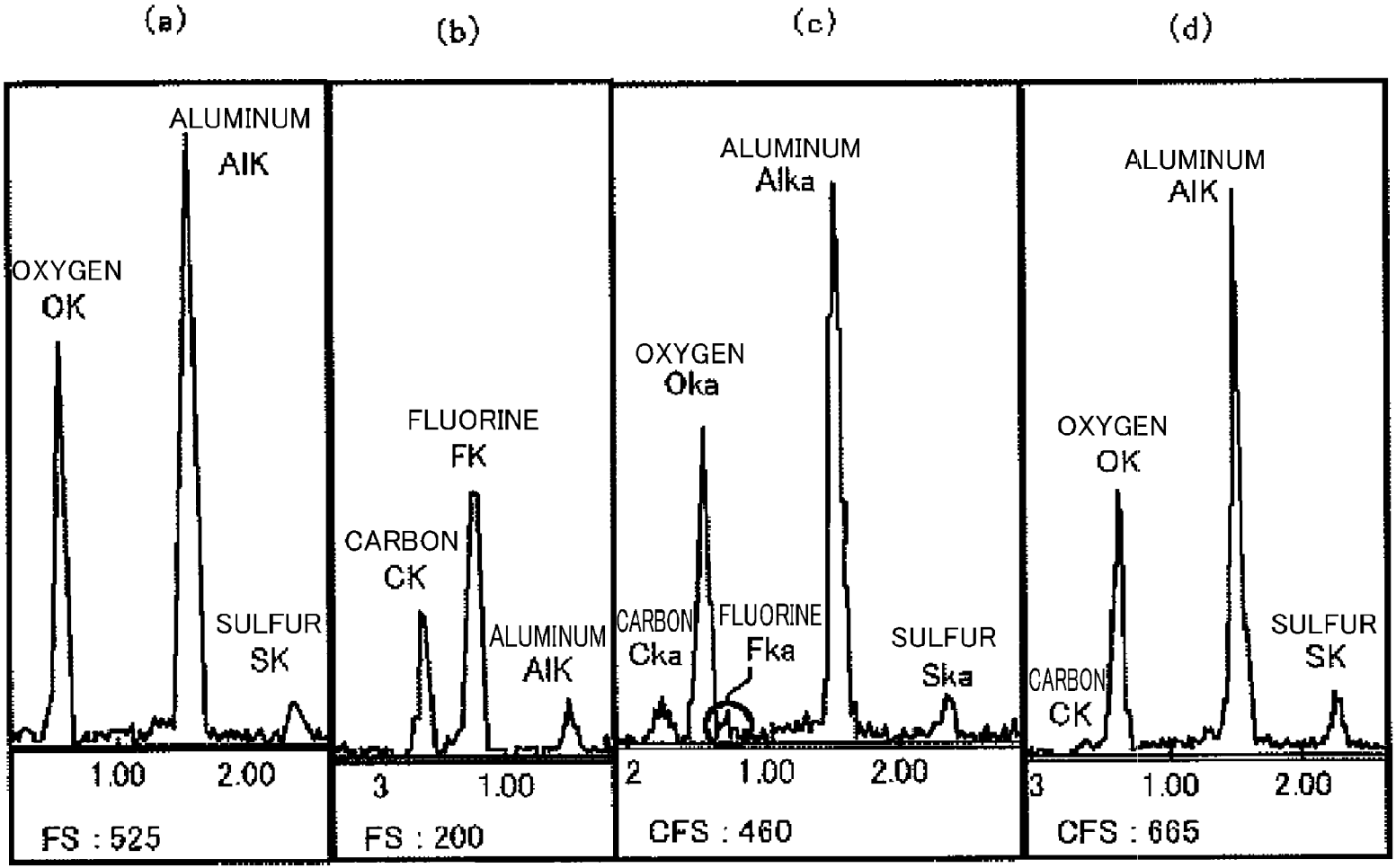
FIG. 9 illustrates graphs showing results of a deposit cleaning effect of the semiconductor manufacturing apparatus cleaning device of FIG. 1.

FIG. 9 shows cleaning effects of a case in which cleaning for removing deposits, which are caused from plasma of a $C_4F_8$ gas and deposited on an imitation sample of parts (a plate (30 mm×30 mm×2 mm) made of aluminum whose surface is anodically oxidized) of a semiconductor manufacturing apparatus, is performed by using the semiconductor manufacturing apparatus cleaning device 100 in accordance with the above-mentioned embodiment and a case in which cleaning is performed by wiping the sample with a nonwoven fabric using alcohol. The comparison of the cleaning effects is shown by analysis results obtained by using an EDX (Energy Dispersive X-ray spectroscopy). In FIG. 9, (a) indicates an analysis result before the deposition of the deposits; (b), an analysis result immediately after the deposition of the deposits; (c), an analysis result after wiping the deposits with the nonwoven fabric using alcohol; and (d), an analysis result after cleaning the deposits by the semiconductor manufacturing apparatus cleaning device 100 in accordance with the above-mentioned embodiment.

Further, in wiping the deposits with the nonwoven fabric using alcohol, the cleaning was performed until no deposits were found on the nonwoven fabric with naked eyes, and the cleaning time was taken about 4 to 5 minutes. Meanwhile, in cleaning the deposits by the semiconductor manufacturing apparatus cleaning device 100, the diameter of the supply port 5 for the pure water steam was about 3 mm; the set temperature inside the pure water steam generating vessel 2 was about 150° C.; the distance between the supply port 5 for the pure water steam and the sample was about 1 to 2 mm; and the cleaning time was taken about 30 seconds.

As depicted in (a) of FIG. 9, before the deposition of the deposits, a peak of O and a peak of Al are high, whereas a peak of C, a peak of F and the like are low. Further, as shown in (b), immediately after the deposition of the deposits, the peak of O and the peak of Al become lower, whereas the peak of C and the peak of F become higher because a surface is covered with the deposits. When the wiping with the nonwoven fabric using alcohol was performed, as shown in (c), though the peak of C and the peak of F become lower while the peak of O and the peak of Al become higher in comparison to (b), it is apparently different from (a) which is a case before the deposition of the deposits.

Meanwhile, when the cleaning by the pure water steam was performed by the semiconductor manufacturing apparatus cleaning device 100 in accordance with the embodiment, as shown in (d), the peak of C and the peak of F become lower while the peak of O and the peak of Al become higher in comparison to (b), so that it became substantially the same state as that of (a) which is a case before the deposition of the deposits. Accordingly, in accordance with the present embodiment, it could be seen that the cleaning effect of removing the deposits is apparently superior to that of the conventional method. Further, since the cleaning time can be reduced to about 1/n of the conventional method, the cleaning can be carried out more efficiently.

What is claimed is:

1. A cleaning device for removing deposits or particles adhered to parts in a processing chamber of a semiconductor manufacturing apparatus, the device comprising:

a pure water steam generating vessel configured to store pure water and generate pure water steam from the pure water;

a supply port configured to supply the pure water steam to a cleaning target portion;

a supply line, made of a pliable material, configured to connect the pure water steam generating vessel with the supply port;

a collection port installed around the supply port and configured to collect steam used in cleaning from the cleaning target portion;

a collection vessel configured to condense and collect the used steam; and a collection line, made of a pliable material, configured to connect the collection port with the collection vessel, wherein a contact surface of the pure water steam generating vessel with the pure water is made of resin, and a contact surface of the supply line with the pure water steam is made of resin, the collection port has an opening end making contact with the cleaning target portion where cleaning target surfaces of an angled portion of a member intersect, and the opening end has a protruded shape in an inverse-V shape as a whole.

2. The cleaning device of claim 1, wherein at least a circumference of an opening portion of the collection port is formed of an elastic member.

3. The cleaning device of claim 1, wherein the supply line and the collection line are configured to have a double tube structure at a part of the supply port and the collection port.

4. The cleaning device of claim 1, wherein a vacuum cleaner serving as a suction source for collecting the used steam is connected to the collection vessel.

5. The cleaning device of claim 4, wherein a filter is installed at the vacuum cleaner.

6. The cleaning device of claim 4, wherein the vacuum cleaner is configured to be connectable with an exhaust path of a clean room.

7. The cleaning device of claim 1, wherein a non-contact surface of the supply line with the pure water steam is made of a conductive material.

8. The cleaning device of claim 1, wherein a heater configured to generate the pure water steam is installed at a lower half part of the pure water steam generating vessel.

9. A cleaning device for removing deposits or particles adhered to parts in a processing chamber of a semiconductor manufacturing apparatus, the device comprising:

a pure water steam generating vessel configured to store pure water and generate pure water steam from the pure water;

a supply port configured to supply the pure water steam to a cleaning target portion;

a supply line, made of a pliable material, configured to connect the pure water steam generating vessel with the supply port;

a collection port installed around the supply port and configured to collect steam used in cleaning from the cleaning target portion;

a collection vessel configured to condense and collect the used steam; and a collection line, made of a pliable material, configured to connect the collection port with the collection vessel, wherein a contact surface of the pure water steam generating vessel with the pure water is made of resin, and a contact surface of the supply line with the pure water steam is made of resin, the collection port has an opening end making contact with the cleaning target portion where cleaning target surfaces of an angled portion of a member intersect, and the opening end has a recessed shape in a V shape as a whole.

10. The cleaning device of claim 9, wherein at least a circumference of an opening portion of the collection port is formed of an elastic member.

11. The cleaning device of claim 9, wherein the supply line and the collection line are configured to have a double tube structure at a part of the supply port and the collection port.

12. The cleaning device of claim 9, wherein a vacuum cleaner serving as a suction source for collecting the used steam is connected to the collection vessel.

13. The cleaning device of claim 12, wherein a filter is installed at the vacuum cleaner.

14. The cleaning device of claim 12, wherein the vacuum cleaner is configured to be connectable with an exhaust path of a clean room.

15. The cleaning device of claim 9, wherein a non-contact surface of the supply line with the pure water steam is made of a conductive material.

16. The cleaning device of claim 9, wherein a heater configured to generate the pure water steam is installed at a lower half part of the pure water steam generating vessel.

* * * * *